US005886633A

United States Patent [19]

Adams

[11] Patent Number: 5,886,633

[45] Date of Patent: Mar. 23, 1999

[54] SELECTIVELY DISCONNECTABLE SENSOR SWITCH FOR AN ALARM

[75] Inventor: Peter J. Adams, St. Thomas, Canada

[73] Assignee: I.S.P.A. Woodworking Limited, Mississauga, Canada

[21] Appl. No.: 106,002

[22] Filed: Jun. 29, 1998

[51] Int. Cl.[6] ..... G08B 13/14

[52] U.S. Cl. ..... 340/568; 340/571; 340/687; 340/691

[58] Field of Search ..... 340/568, 571, 340/687, 691, 572, 502, 693; 439/917

[56] References Cited

U.S. PATENT DOCUMENTS

| | | | |
|---|---|---|---|
| 5,341,124 | 8/1994 | Leyden et al. | 340/691 |
| 5,604,484 | 2/1997 | Rogers | 340/572 |
| 5,796,337 | 8/1998 | Wachsman | 340/568 |

*Primary Examiner*—Jeffery A. Hofsass
*Assistant Examiner*—Anh La
*Attorney, Agent, or Firm*—Patrick J. Hofbauer

[57] ABSTRACT

A security apparatus for selectively releasable secured coupling of a displayed product to a multiconductor cord to preclude unauthorized uncoupling of the displayed product from the multiconductor cord, comprises a housing having a base portion with an adhesive product facing surface, and a cover portion mounted on the base portion. A product detector on the housing is responsive to the secure attachment of the displayed product to produce a first signal, and to detachment of the displayed product, corresponding to the unauthorized uncoupling of the displayed product from the multiconductor cord, to produce a second signal. The multiconductor cord terminates in a connector member connectable to a co-operating receptacle portion within the housing, thereby electrically interconnecting in signal conducting relation the product detector and an alarm system, such that the alarm system is quiescent in response to the first signal and produces the warning in response to the second signal. The cover portion is adapted to restrict access to a lock mechanism when the connector member is connected to the receptacle portion, thereby precluding disconnection of the connector member from the receptacle portion, and thus the unauthorized uncoupling of the display product from the security apparatus.

34 Claims, 7 Drawing Sheets

SELECTIVELY DISCONNECTABLE SENSOR SWITCH FOR AN ALARM

FIELD OF THE INVENTION

The present invention relates to a security apparatus for secured coupling of a displayed product to a multiconductor cord connected to an alarm system, and more particularly to such a security apparatus that disconnects from the multiconductor cord in a selectively releasable manner.

BACKGROUND OF THE INVENTION

In retail settings, it is common to display various types of small electronic products, such as cellular telephones, remote controls, calculators, electronic schedulers, and so on, in a retail display that permits potential customers to hold and use these electronic products in an intended manner. However, it has been found that it is necessary to tether such small electronic products to the retail display in order to preclude theft.

While in some retail displays the displayed products are simply tethered to a common base via a steel cable, a coiled cord, or the like, it is becoming increasingly common to employ a retail display product security system in order to help preclude theft of small electronic products. The various components of one such security system are disclosed in U.S. Pat. No. 5,552,771 (Leyden et al) and U.S. Pat. No. 5,172,098 (Leyden et al), which patents are incorporated herein by reference. Typically, such systems use miniature electrical cables, also known as multiconductor cords, such as that disclosed in U.S. Pat. No. 5,516,986 (Peterson et al), which patent is also incorporated herein by reference, to couple displayed products to an alarm system through a cord take-up device, such as that disclosed in U.S. Pat. No. 5,230,481 (Wheeler et al), which patent is also incorporated herein by reference.

In such security systems, the free end of each multiconductor cord is permanently connected to a sensor containing a microswitch. Most preferably, the sensor is very securely adhered by means of adhesive or the like to a portion of the displayed product, such that there is minimal interference with the displayed product, and such that it is extremely difficult to detach the displayed product from the sensor. Typically such detachment cannot be done without damaging part of the sensor, and/or the displayed product. The multiconductor cord effectively tethers the displayed product to the retail display and forms part of an alarm circuit. If the displayed product becomes detached from the microswitch, the multiconductor cord is cut, or the circuit of the sensor is otherwise damaged, (all of which will open the alarm circuit), the alarm system provides an audible and/or visible indication.

There are significant drawbacks to such known prior art retail display product security systems. The end of each multiconductor cord connected to the alarm system is disposed behind the retail display, or even remote from the retail display, and typically cannot readily be accessed without at least partially disassembling the retail display. Moreover, the free end of the multiconductor cord is permanently connected (i.e. hard-wired) to the sensor, as described above. Accordingly, it is difficult and time consuming to change a displayed product attached to one of the sensors, as is frequently required, since the displayed product must be physically detached from the sensor, preferably without damaging the displayed product. This problem is amplified where an entire display inventory must be simultaneously changed. Moreover, it is often necessary to perform such replacement in the retail setting itself, often in front of customers, which is highly undesirable. Further, if a displayed product requires replacement, it is preferably done immediately, which is frequently not possible, such as during busy store hours. Moreover, once a prior art sensor attached by adhesives is removed from a displayed product, the adhesive area must typically be reconditioned before the sensor can successfully be re-attached in a secure manner to the displayed product. This is not typically done in the product display area, but behind the scenes.

Finally, known prior art sensors have substantially planar attachment surfaces, and therefore cannot readily attach to curved product surfaces or to a displayed product on more than one surface, such as the back and side surfaces, for instance, which may mean that the displayed product and its battery cannot be simultaneously secured by a single sensor.

It is an object of the present invention to provide a security apparatus for secured coupling of a displayed product to a multiconductor cord, and for use with an alarm system, wherein a displayed product disconnects from a multiconductor cord in a selectively releasable manner.

It is another object of the present invention to provide a security apparatus for secured coupling of a displayed product to a multiconductor cord, and for use with an alarm system, wherein the multiconductor cord comprises a miniature electrical cable.

It is yet another object of the present invention to provide a security apparatus for secured coupling of a displayed product to a multiconductor cord, and for use with an alarm system, wherein the multiconductor cord is retained in a cord take-up device.

It is a further object of the present invention to provide a security apparatus for secured coupling of a displayed product to a multiconductor cord, and for use with an alarm system, wherein the alarm system provides an audible and/or visible indication if the multiconductor cord is cut, if the displayed product becomes detached from the security apparatus, or if the circuitry of the security apparatus is damaged.

It is yet a further object of the present invention to provide a security apparatus for secured coupling of a displayed product to a multiconductor cord, and for use with an alarm system, wherein the free end of the multiconductor cord is not permanently connected to the security apparatus, but is readily disconnectable therefrom in a selectively releasable manner.

It is another object of the present invention to provide a security apparatus for secured coupling of a displayed product to a multiconductor cord, and for use with an alarm system, wherein it is quick and easy to uncouple the displayed product from the multiconductor cord by authorized personnel, without the need of such personnel to gain access behind the product display.

It is yet another object of the present invention to provide a security apparatus for secured coupling of a displayed product to a multiconductor cord, and for use with an alarm system, wherein the displayed product may be quickly uncoupled from the displayed product without detaching the displayed product from the sensor, and wherein a new displayed product with a fresh sensor already securely attached to it may be quickly and securely coupled to the multiconductor cord in place of the original displayed product.

It is still a further object of the present invention to provide a security apparatus for secured coupling of a displayed product to a multiconductor cord, and for use with an alarm system, which security apparatus can simultaneously attach to a displayed product on more than one surface.

SUMMARY OF THE INVENTION

In accordance with the present invention there is disclosed a security apparatus for secured coupling of a displayed product to a multiconductor cord in a selectively releasable manner to preclude unauthorized uncoupling of the displayed product from the multiconductor cord, for use in conjunction with an alarm system to provide a warning in the events of the uncoupling or tampering. The security apparatus comprises a housing means having a base portion and a cover portion mounted on the base portion. The base portion has a product facing surface and attachment means secured to the product facing surface for secure attachment of the security apparatus and the displayed product one to the other. A product detector means is operatively mounted on the housing means and is responsive to the secure attachment of the displayed product to produce a first signal, and to detachment of the displayed product, corresponding to the unauthorized uncoupling of the displayed product from the multiconductor cord, to produce a second signal. The multiconductor cord terminates in a connector member connectable to a co-operating receptacle portion within the housing means, thereby electrically interconnecting in signal conducting relation the product detector means and the alarm system, such that the alarm system is quiescent in response to the first signal and produces the warning in response to the second signal. The multiconductor cord has a lock mechanism releasably lockably engageable with a co-operating catch portion on the receptacle portion. The cover portion is adapted to restrict access to the lock mechanism when the connector member is connected to the receptacle portion, thereby precluding disconnection of the connector member from the receptacle portion, and thus the unauthorized uncoupling of the display product from the security apparatus. An access passageway extends from the exterior of the housing means to the receptacle portion, to permit access to the lock mechanism by a co-operating key member, for selective disconnection of the connector member from the receptacle portion, thereby permitting authorized uncoupling of the display product from the security apparatus.

Other advantages, features and characteristics of the present invention, as well as methods of operation and functions of the related elements of the structure, and the combination of parts and economies of manufacture, will become more apparent upon consideration of the following detailed description and the appended claims with reference to the accompanying drawings, the latter of which is briefly described hereinbelow.

BRIEF DESCRIPTION OF THE DRAWINGS

The novel features which are believed to be characteristic of the security apparatus according to the present invention, as to its structure, organization, use and method of operation, together with further objectives and advantages thereof, will be better understood from the following drawings in which a presently preferred embodiment of the invention will now be illustrated by way of example. It is expressly understood, however, that the drawings are for the purpose of illustration and description only, and are not intended as a definition of the limits of the invention. In the accompanying drawings.

DETAILED DESCRIPTION OF A PREFERRED EMBODIMENT

Figure 1:
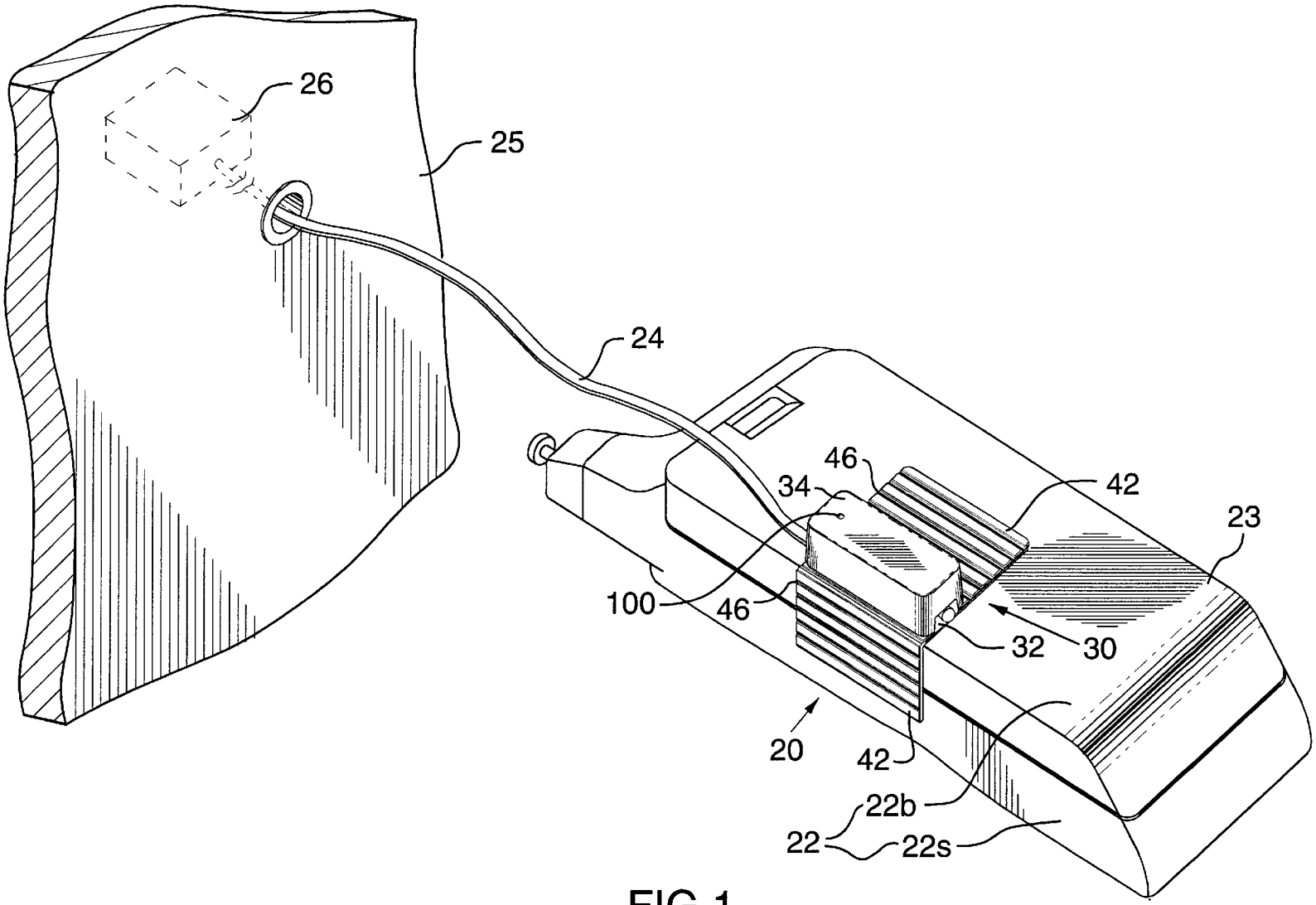
FIG. 1 is a perspective view of a preferred embodiment of the security apparatus according to the present invention, with a multiconductor cable from a retail display connected thereto and with a displayed product attached thereto.

Referring now to FIGS. 1 through 15 of the drawings, there is shown a preferred embodiment of a security apparatus of the present invention, as indicated by the general reference numeral 20. As can be best seen in FIGS. 1 through 4, the security apparatus 20 is for secured coupling of a displayed product, such as a cellular telephone 22, as illustrated, or other products such as remote controls, calculators, electronic schedulers, and so on (not illustrated), to a multiconductor cord 24 in a selectively releasable manner, as indicated by arrows "A" in FIG. 2, to preclude unauthorized uncoupling of the displayed product 22 from the multiconductor cord 24. Further, the security apparatus 20 is for use in conjunction with an alarm system 26, as indicated in ghost outline in FIG. 1, to provide a warning, either audible or visible, or both, in the events of the uncoupling of the displayed product 22 from the multiconductor cord 24, or tampering with the displayed product 22, the security apparatus 20, or the multiconductor cord 24. The alarm system 26 is typically located at a location remote from the displayed product 22, behind a partition 25, or the like, so as to prevent unauthorized tampering of the alarm system 26.

Referring now to FIGS. 5 through 11 of the drawings, it can be seen that the security apparatus 20 comprises a housing means, as indicated by the general reference numeral 30, having a base portion 32 and a cover portion 34 mounted on the base portion 32, preferably integrally formed one with the other. The cover portion 34 and the base portion 32 are injection molded from a flexible plastics material, such as polypropylene and are interconnected one to the other by means of a flexible hinge portion 36. The flexible plastics material should preferably have at least some memory. For ease of assembly of the security apparatus 20, the cover portion 34 is permitted to move with respect to the base portion 32 by means of the flexible hinge portion 36, from an open position as can be best seen in FIGS. 8 through 11, to a closed position as can be best seen in FIGS. 5 through 7, whereat the cover portion 34 is mounted on the base portion 32. During assembly of the various components into the security apparatus, the cover portion 34 is in its open position. After assembly of the various components, the cover portion 34 is closed over the base portion 32, as indicated by arrow "B" in FIG. 8, and the cover portion 34 and the base portion 32 are heat welded, ultrasonically welded, or glued one to the other, so as to preclude subsequent separation one from the other.

Figure 7:
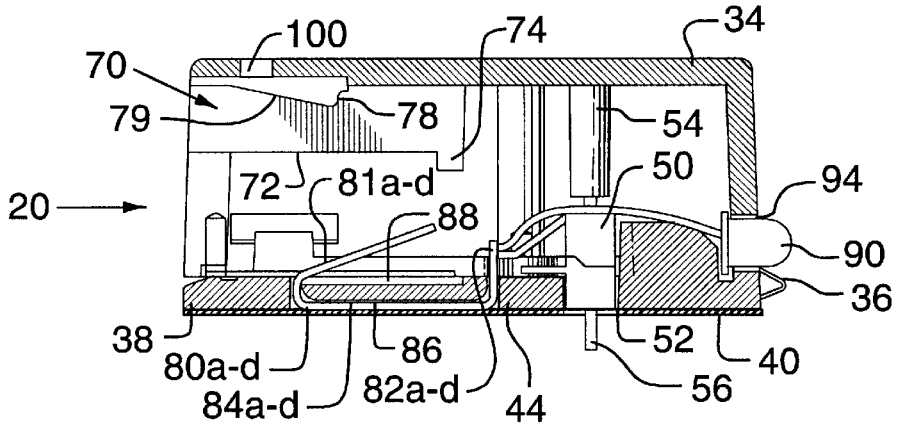
FIG. 7 is a sectional side elevational view of the preferred embodiment of the security apparatus of FIG. 5, taken along section line 7—7 of FIG. 6.
Figure 8:
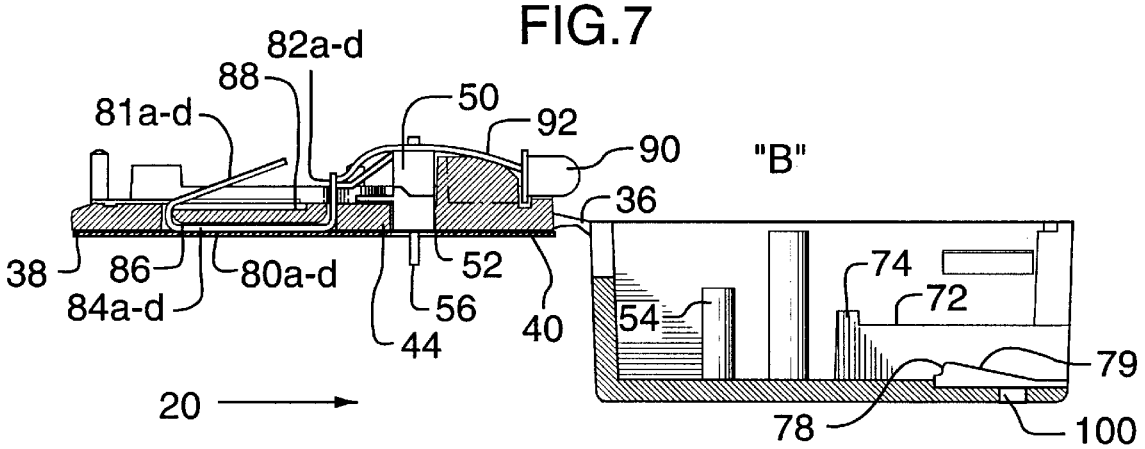
FIG. 8 is a sectional side elevational view similar to FIG. 7, with the cover portion in an open position.

The base portion 32 also has, on its underside, a product facing surface 38, as can be best seen in FIGS. 7 and 8, for receiving a portion of at least one surface of the displayed product 22. An attachment means 40 is secured to the product facing surface 38 for secure attachment of the security apparatus and the displayed product 22 one to the other. In the preferred embodiment, the product facing surface 38 of the base portion 32 presents an attachment means 40 comprising an adhesive impregnated low foam, for example, a low energy adhesive foam available from 3M Company of Minneapolis, Minn., U.S.A. under stock number 3M VHB4432.

Figure 2:
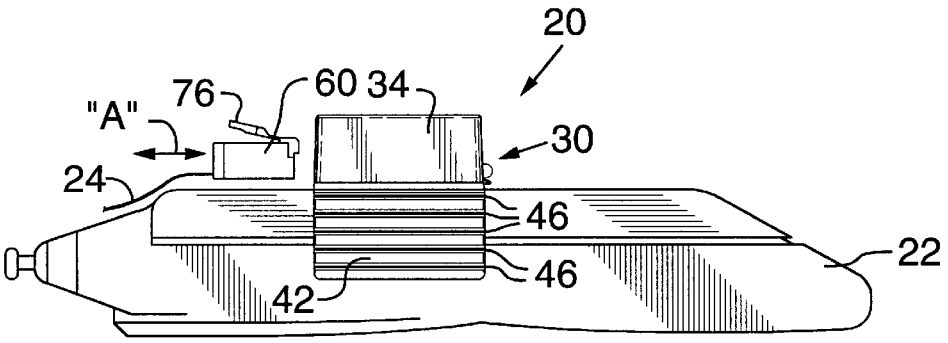
FIG. 2 is a side elevational view of the preferred embodiment of the security apparatus of FIG. 1, with the multiconductor cable disconnected from the security apparatus, but still shown.
Figure 3:
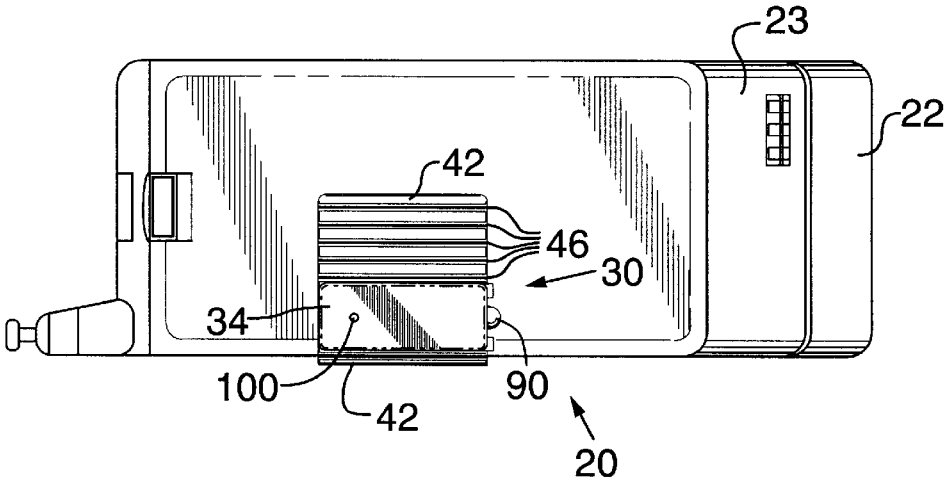
FIG. 3 is a top plan view of the preferred embodiment of the security apparatus of FIG. 1, with the multiconductor cable not shown.
Figure 4:
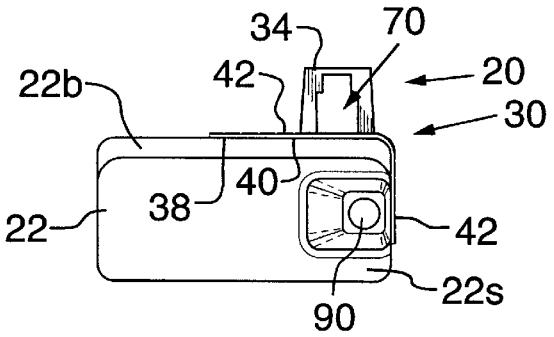
FIG. 4 is a end elevational view of the preferred embodiment of the security apparatus of FIG. 1, with the multiconductor cable not shown.
Figure 5:
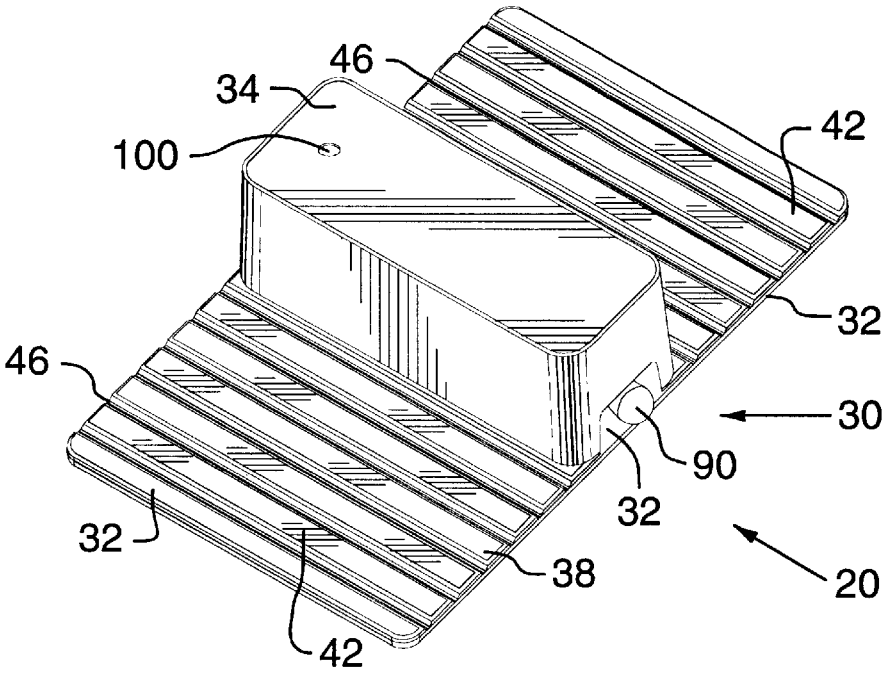
FIG. 5 is a perspective view of the preferred embodiment of the security apparatus of FIG. 1, but not having a displayed product attached thereto.
Figure 6:
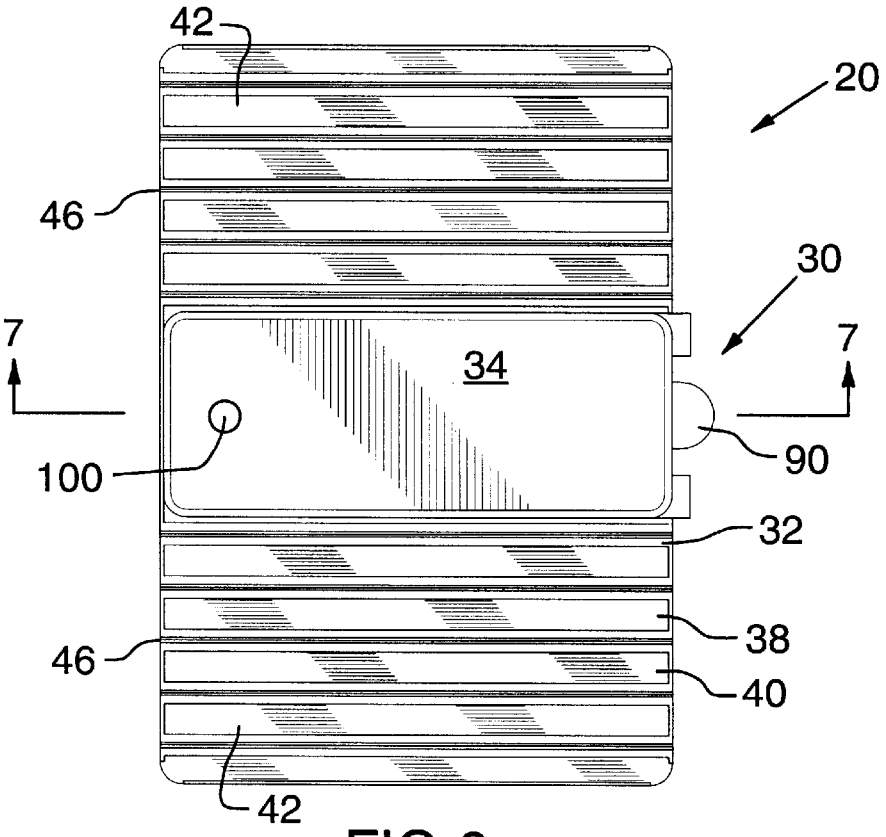
FIG. 6 is a top plan view of the preferred embodiment of the security apparatus of FIG. 5.

As can be best seen in FIGS. 1 and 4, the base portion 32 of the housing means 30 is flexible, so as to be attachable to curved product surfaces or to a displayed product 22 on more than one surface, such as the back surface 22*b* and side surface 22*s*. In this manner, as illustrated, the displayed product 22 and its battery 23 cannot be simultaneously secured by a single security apparatus 20. In order to accomplish such flexibility, the base portion 32 of the housing means 30 comprises at least one flexible flap portion 42 extending outwardly from a central portion 44 (see especially FIG. 9), and in the preferred embodiment as illustrated, comprises two flexible flap portions 42 extending outwardly in opposed directions from the central portion 44. Further, the two flexible flap portions 42 each include at least one score 46 therein, and several scores 46 in the preferred embodiment, to facilitate flexing.

Also, the base portion 32 of the housing means 30 has an alterable footprint in that the two flexible flap portions 42 may readily be cut, merely by using scissors or the like, to virtually any desired shape. In this manner, the security apparatus 20 may be manufactured in one size only, and be large enough to provide very secure attachment to large displayed products, and also be attachable to small displayed products.

The security apparatus 20 further comprises a product detector means 50 operatively mounted on the housing means 30, and which is responsive to the secure attachment of the displayed product 22 to the security apparatus 20, to produce a first signal, and to detachment of the displayed product 22 from the security apparatus 20, corresponding to the unauthorized uncoupling of the displayed product 22 from the multiconductor cord 24, to produce a second signal.

Figure 11:
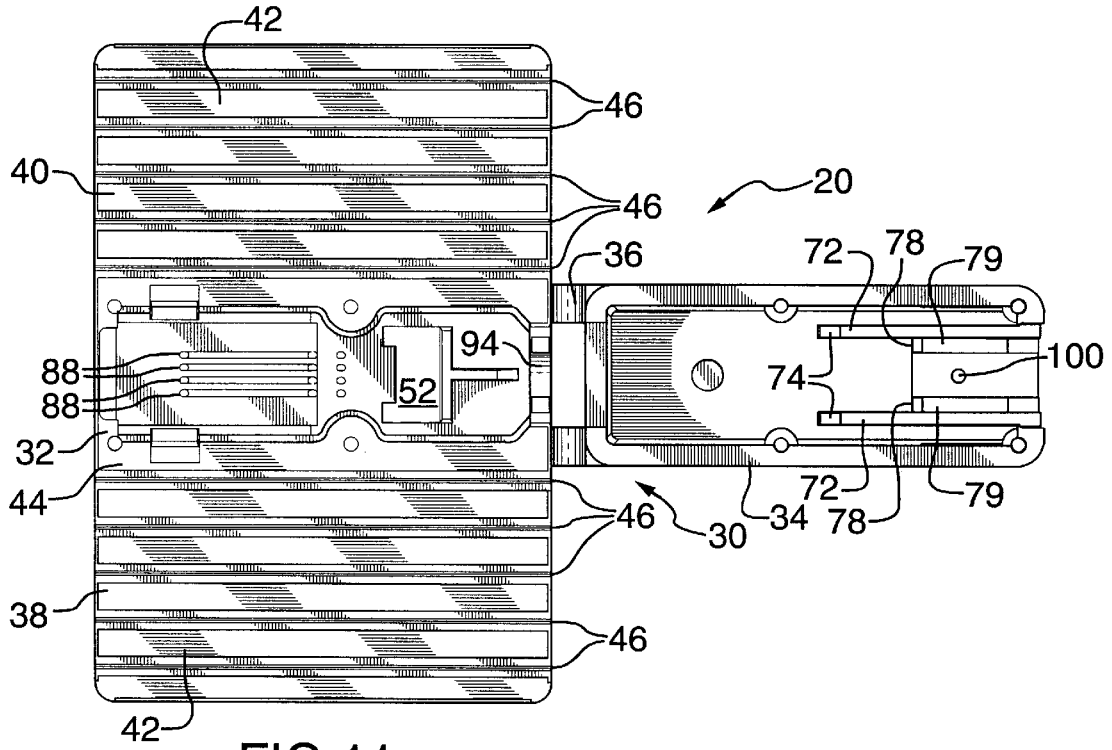
FIG. 11 is a top plan view similar to FIG. 10, with various parts removed for the sake of clarity.
Figure 12:
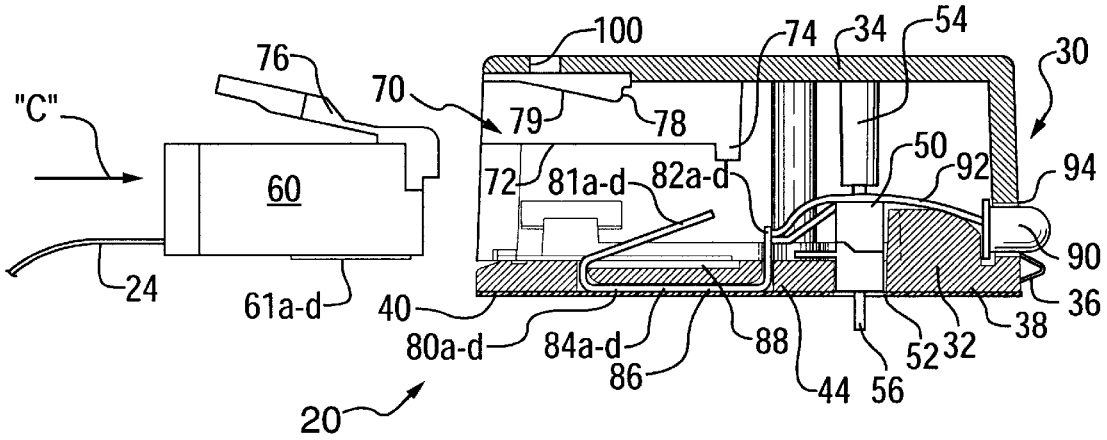
FIG. 12 is a sectional side elevational view similar to FIG. 7, with the cover portion in a closed position, and with a connector about to be inserted into the receptacle of the security apparatus.

In the preferred embodiment illustrated, the product detector means 50 comprises a microswitch 50 mounted within a co-operating opening 52 in the base portion 32 of the housing means 30, which opening 52 is best seen in FIG. 11. A co-operating post member 54 on the cover portion 34 and projecting into the interior of the housing means 30 retains the microswitch 50 securely in place in the base portion 32, as can be best seen in FIG. 7. The microswitch 50 protrudes through the opening 52 in base portion 32, beyond the product facing surface 38, whereat an actuator plunger 56 operatively contacts the displayed product 22, when the displayed product 22 is securely attached to the base portion 32 of the housing means 30. The microswitch 50 is a normally open microswitch. Accordingly, the microswitch 50 is electrically closed when the security apparatus 20 and the displayed product 22 are attached one to the other, to thereby produce the first signal. Further, the microswitch 50 is electrically open when the and the displayed product 22 are separated one from the other, to thereby produce the second signal.

The multiconductor cord 24 terminates in a connector member 60, preferably an RJ9 type telephone connector or an RJ11 type telephone connector having four electrical contacts 61*a*, 61*b*, 61*c*, and 61*d*. The connector member 60 is insertable into a co-operating receptacle portion, as indicated by the general reference numeral 70, within the housing means 30, as indicated by arrows "C" and "D" in FIGS. 12 and 13, respectively. The connector member 60 is thereby connectable to the co-operating receptacle portion 70. The receptacle portion 70 is defined by the base portion 32 and the cover portion 34 of the housing means 30, and substantially surrounds the microswitch 50 and the connector member 60, when the connector member 60 is inserted into the receptacle portion 70, as can be best seen in FIGS. 13 and 14. The receptacle portion 70 is preferably adapted to connect to one of an RJ9 type telephone plug and an RJ11 type telephone plug, and an RJ9 telephone plug is shown.

The receptacle portion 70 further comprises a pair of opposed substantially parallel guide flanges 72 formed on the cover portion 34 so as to be positioned in the receptacle portion 70 in guiding relation to the connector member 60. Stop means 74 are included in the opposed substantially parallel guide flanges 72 for receiving the connector member 60 upon insertion of the connector member 60 into the receptacle portion 70.

A lock mechanism 76 is also included in the connector member 60, which lock mechanism 76 is releasably lockably engageable with a co-operating catch portion 78 on the receptacle portion 70. The co-operating catch portion 78 comprises a pair of abutment surfaces 78 formed on the cover portion 34, one catch portion 78 adjacent each of the opposed substantially parallel guide flanges 72.

The receptacle portion 70 also comprises a pair of ramp portions 79 shaped to guide the connector member 60 into the receptacle portion 70, which pair of ramp portions 79 is formed on the cover portion 34, one ramp portion 79 adjacent each of the opposed substantially parallel guide flanges 72. In the preferred embodiment, as illustrated, each of the abutment surfaces 78 is integrally formed with a respective ramp portion 79.

Included in the receptacle portion 70 of the housing means 30 is a plurality of electrical contacts 80*a*, 80*b*, 80*c*, and 80*d*, which electrical contacts 80*a*, 80*b*, 80*c*, and 80*d*, bias the connector member 60 into engagement with the receptacle portion 70 of the housing means 30. In the preferred embodiment, as illustrated, the electrical contacts

80*a*, 80*b*, 80*c*, and 80*d*, are each elongate, having first 81*a*, 81*b*, 81*c*, and 81*d*, and second 82*a*, 82*b*, 82*c*, and 82*d* ends, with the first 81*a*, 81*b*, 81*c*, and 81*d* and second 82*a*, 82*b*, 82*c*, and 82*d* ends of each electrical contact 80*a*, 80*b*, 80*c*, and 80*d*, being disposed within the receptacle portion 70 of the housing means 30, and with an intermediate portion 84*a*, 84*b*, 84*c*, and 84*d*, of each electrical contact 80*a*, 80*b*, 80*c*, and 80*d* being disposed exteriorly to the housing means 30, and received in recessed relation within a corresponding plurality of elongate exterior recesses 86, each exterior recess 86 to receive one of the intermediate portions 84*a*, 84*b*, 84*c*, and 84*d* of the electrical contacts 80*a*, 80*b*, 80*c*, and 80*d*. The base portion 32 of the housing means 30 includes a plurality of elongate interior recesses 88 therein, each interior recess 88 to receive one of the first ends 81*a*, 81*b*, 81*c*, and 81*d* of the electrical contacts 80*a*, 80*b*, 80*c*, and 80*d*. Accordingly, in the preferred embodiment, and as can be best seen in FIG. 13, the first ends 81*a*, 81*b*, 81*c*, and 81*d* of the electrical contacts 80*a*, 80*b*, 80*c*, and 80*d* bias the connector member 60 into engagement with the cover portion 34.

When the connector member 60 is connected to the co-operating receptacle portion 70, the four electrical contacts 61*a*, 61*b*, 61*c*, and 61*d*, engage in electrically conductive relation with the four co-operating electrical contacts 80*a*, 80*b*, 80*c*, and 80*d*, in the receptacle portion 70. The two outer electrical contacts 80*a*, 80*d* are physically connected and soldered, for proper electrical conductivity, to the leads of the microswitch 50. Accordingly, the product detector means 50, namely the microswitch 50, and the alarm system 26, are electrically interconnected in signal conducting relation, such that the alarm system 26 is quiescent in response to the first signal from the product detector means 50, and produces the warning in response to the second signal from the product detector means 50.

Figure 9:
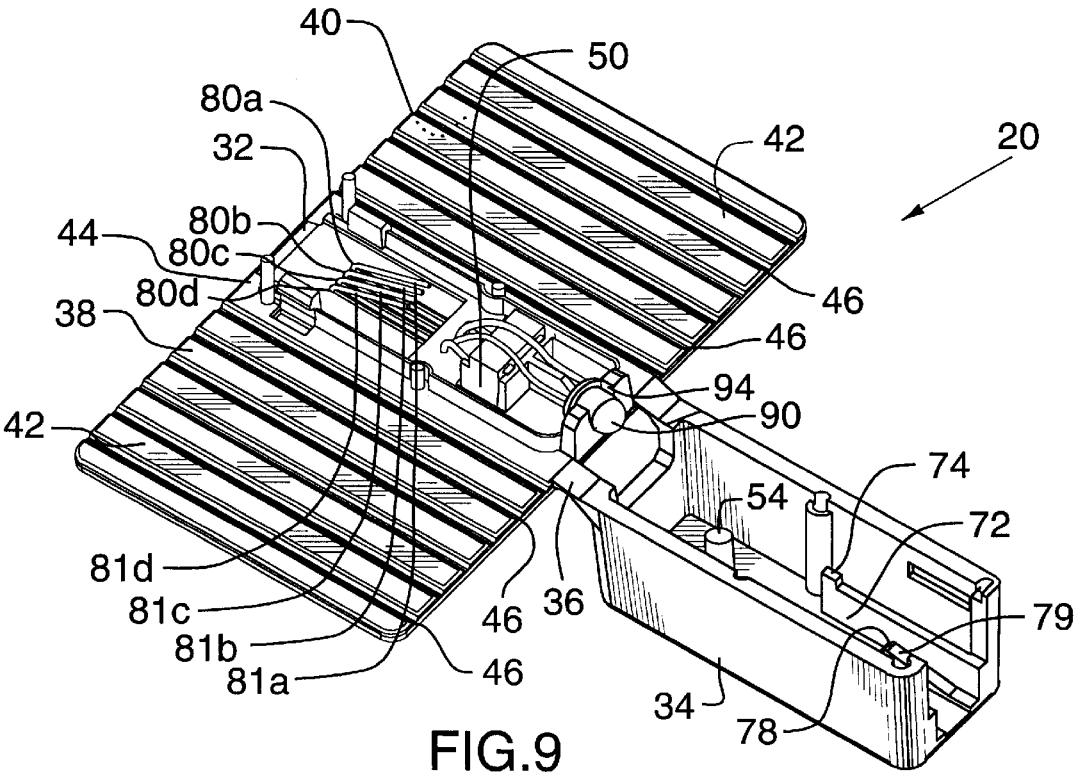
FIG. 9 is a perspective view similar to FIG. 5, with the cover portion in an open position.
Figure 10:
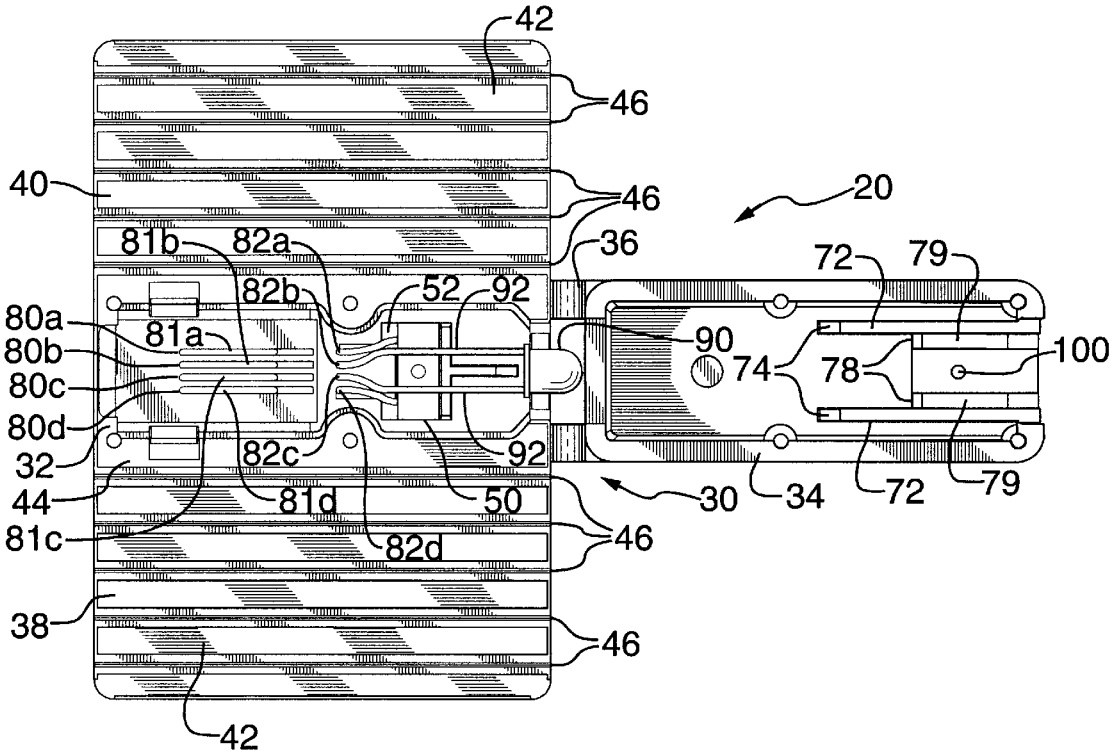
FIG. 10 is a top plan view similar to FIG. 6, with the cover portion in an open position.

The two inner contacts 80*b*, 80*c* are physically connected, as can be best seen in FIGS. 9 and 10, and soldered, for proper electrical conductivity, to the leads 92 of a light emitting diode 90 mounted in the housing means 30 between the base portion 32 and the cover portion 34, within a co-operating recess 94 in the base portion 32, so as to be exteriorly visible. The light emitting diode 90 is thereby electrically connected to the output of the alarm system 26 by means of the multiconductor cord 24. Upon such connection, the light emitting diode 90 is illuminated, thus confirming to authorized personnel that the alarm system 26 is armed for detection of that particular security apparatus 20. Also, in this manner, the light emitting diode 90 acts as a possible deterrent to potential thieves.

When the alarm system 26 produces the aforesaid warning in response to the second signal from the microswitch 50, the light emitting diode 90 may remain illuminated, depending on the particular circuitry and logic of the alarm system 26 and depending on the cause of the second signal. In the event that the displayed product 22 becomes detached from the security apparatus 20, the light emitting diode 90 may or may not remain illuminated, as aforesaid. However, if the electrical path within the security apparatus 20 to the light emitting diode 90, namely the two inner contacts 80*a*, 80*c*, is interrupted, or if the conductors within the multiconductor cord 24 that lead to the two inner contacts 80*a*, 80*c* become cut or otherwise damaged so as to interrupt the electrical path, the light emitting diode 90 will not remain illuminated.

Figure 13:
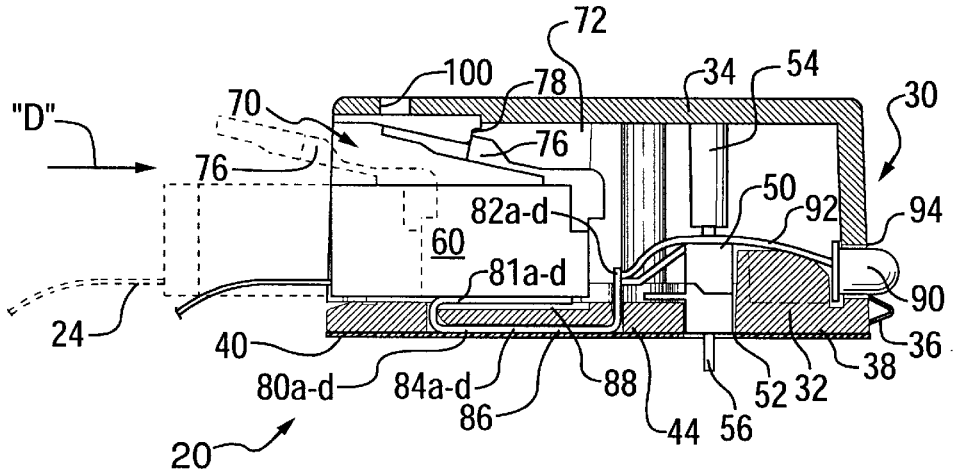
FIG. 13 is a sectional side elevational view similar to FIG. 12, with a connector having been inserted into the receptacle of the security apparatus.
Figure 14:
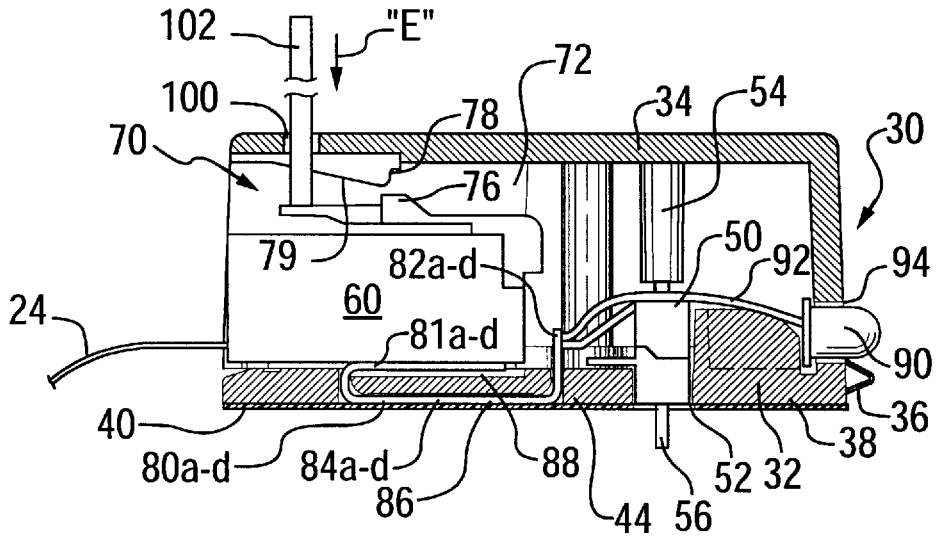
FIG. 14 is a sectional side elevational view similar to FIG. 13, with a connector being released from locked engagement; and, FIG. 15 is a sectional side elevational view similar to FIG. 14, with a connector being removed from the receptacle of the security apparatus.
Figure 15:
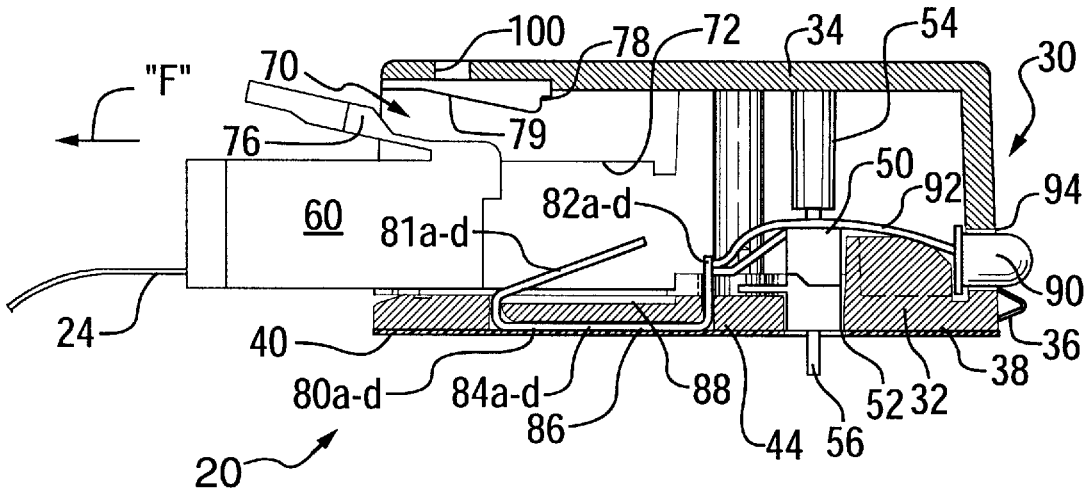

The cover portion 34 is also adapted to restrict access to the lock mechanism 76 by generally covering over the lock mechanism 76, when the connector member 60 is connected to the receptacle portion 70, as can be best seen in FIGS. 13 and 14. The cover portion 34 thereby precludes disconnection of the connector member 60 from the receptacle portion 70, and thus precludes the unauthorized uncoupling of the displayed product 22 from the security apparatus 20. In this manner, in order to, without authorization, uncouple the displayed product 22 from the multiconductor cord 24, either the multiconductor cord 24 must be cut, the displayed product 22 must be forcefully detached from the security apparatus 20, or the security apparatus 20 must be broken. On the occurrence of any of these events, the electrical circuitry within the security apparatus 20, or the wires in the multiconductor cord 24, would be broken, thus opening the circuit to the alarm system 26, and causing the alarm system 26 to produce the aforesaid warning.

An access passageway comprising a small diameter aperture 100 is disposed in the cover portion 34 of the housing means 30, between the ramp portions 79. The access passageway 100 extends from the exterior of the housing means 30 to the receptacle portion 70, to permit access to the lock mechanism 76 by a co-operating key member 102, as can be best seen in FIG. 14. The key member 102 is used by authorized personnel to press downwardly on the lock mechanism 76, as indicated by arrow "E", until the lock mechanism 76 is released from aforesaid locking engagement with the co-operating catch portion 78. In this manner, access to the lock mechanism 76 by the key member 102 allows selective disconnection of the connector member 60 from the receptacle portion 70, thereby permitting authorized uncoupling of the displayed product 22 from the security apparatus 20, as indicated by arrow "F" in FIG. 15. It should be noted that when the connector member 60 is disconnected from the security apparatus 20, the electrical circuit from the microswitch 50 to the alarm system 26 is broken, and accordingly, the alarm system 26 produces the aforesaid warning. If the key 102 is being used by authorized personnel (typically the case), the warning would be ignored, or the alarm system 26 could first be rd-activated.

Other variations of the above principles will be apparent to those who are knowledgeable in the field of the invention, and such variations are considered to be within the scope of the present invention. Further, other modifications and alterations may be used in the design and manufacture of the apparatus of the present invention without departing from the spirit and scope of the accompanying claims. For example, while a simple key member 102 is shown, more complex profiles for such key members and correspondingly complex access passageways adapted to accept such key members can be readily substituted for the arrangement shown.

I claim:

1. A security apparatus for secured coupling of a displayed product to a multiconductor cord in a selectively releasable manner to preclude unauthorized uncoupling of said displayed product from said multiconductor cord, for use in conjunction with an alarm system to provide a warning in the events of said uncoupling or tampering, said security apparatus comprising:

a housing means having a base portion and a cover portion mounted on said base portion, said base portion having a product facing surface and attachment means secured to said product facing surface for secure attachment of said security apparatus and said displayed product one to the other;

product detector means operatively mounted on said housing means and responsive to said secure attachment of said displayed product to produce a first signal, and to detachment of said displayed product, corresponding to said unauthorized uncoupling of said displayed product from said multiconductor cord, to produce a second signal;

said multiconductor cord terminating in a connector member connectable to a co-operating receptacle portion within said housing means, thereby electrically interconnecting in signal conducting relation said product detector means and said alarm system, such that said alarm system is quiescent in response to said first signal and produces said warning in response to said second signal, and having a lock mechanism releasably lockably engageable with a co-operating catch portion on said receptacle portion;

wherein said cover portion is adapted to restrict access to said lock mechanism when the connector member is connected to said receptacle portion, thereby precluding disconnection of said connector member from said receptacle portion, and thus said unauthorized uncoupling of said display product from said security apparatus;

an access passageway extending from the exterior of said housing means to said receptacle portion, to permit access to said lock mechanism by a co-operating key member, for selective disconnection of said connector member from said receptacle portion, thereby permitting authorized uncoupling of said display product from said security apparatus.

2. The security apparatus of claim 1, wherein said receptacle portion substantially surrounds said connector member and said product detector means, when said connector member is inserted into said receptacle portion.

3. The security apparatus of claim 2, wherein said receptacle portion of said housing means includes a plurality of electrical contacts, which electrical contacts bias said connector member into engagement with said receptacle portion.

4. The security apparatus of claim 3, wherein said electrical contacts are each elongate, having first and second ends, with said first and second ends of each electrical contact being disposed within said housing means, and with an intermediate portion of each electrical contact being disposed exteriorly to said housing means.

5. The security apparatus of claim 4, wherein said first ends of said electrical contacts bias said connector member into engagement with said cover portion.

6. The security apparatus of claim 5, wherein said base portion of said housing means includes a plurality of elongate interior recesses therein, each interior recess to receive one of said first ends of said electrical contacts.

7. The security apparatus of claim 6, wherein said base portion of said housing means includes a plurality of elongate exterior recesses therein, each exterior recess to receive one of said intermediate portions of said electrical contacts.

8. The security apparatus of claim 7, further comprising a pair of opposed substantially parallel guide flanges positioned in said receptacle portion in guiding relation to said connector member.

9. The security apparatus of claim 8, wherein said opposed substantially parallel guide flanges include stop means for receiving said connector member upon insertion of said connector member into said receptacle portion.

10. The security apparatus of claim 9, wherein said opposed substantially parallel guide flanges are formed on said cover portion.

11. The security apparatus of claim 10, wherein said cooperating catch portion comprises a pair of abutment surfaces.

12. The security apparatus of claim 11, wherein said pair of abutment surfaces is formed on said cover portion.

13. The security apparatus of claim 12, wherein said pair of abutment surfaces is formed one adjacent each said opposed substantially parallel guide flange.

14. The security apparatus of claim 13, further comprising a pair of ramp portions shaped to guide said connector member into said receptacle portion.

15. The security apparatus of claim 14, wherein said pair of ramp portions is formed on said cover portion.

16. The security apparatus of claim 15, wherein said pair of ramp portions is formed one adjacent each said opposed substantially parallel guide flange.

17. The security apparatus of claim 16, wherein each of said abutment surfaces is integrally formed with a respective ramp portion.

18. The security apparatus of claim 17, wherein said access passageway comprises an aperture disposed in said cover portion.

19. The security apparatus of claim 18, wherein said aperture is disposed between said ramp portions.

20. The security apparatus of claim 19, wherein said receptacle portion is adapted to connect to one of an RJ9 type telephone plug and an RJ11 type telephone plug.

21. The security apparatus of claim 20, wherein said base portion and said cover portion are integrally formed one with the other.

22. The security apparatus of claim 21, wherein said cover portion and said base portion are injection molded from a flexible plastics material.

23. The security apparatus of claim 22, wherein said cover portion and said base portion are interconnected by means of a flexible hinge portion.

24. The security apparatus of claim 23, wherein said base portion of said housing means has an alterable footprint.

25. The security apparatus of claim 24, wherein said base portion of said housing means is flexible.

26. The security apparatus of claim 25, wherein said base portion of said housing means comprises at least one flexible flap portion extending outwardly from a central portion.

27. The security apparatus of claim 26, wherein said base portion of said housing means comprises two flexible flap portions extending outwardly in opposed directions from said central portion.

28. The security apparatus of claim 27, wherein said two flexible flap portions each include at least one score therein to facilitate flexing.

29. The security apparatus of claim 28, wherein said product facing surface of said base portion presents an adhesive.

30. The security apparatus of claim 29, wherein said product detector means comprises a microswitch.

31. The security apparatus of claim 30, wherein said microswitch protrudes through an opening in base portion, beyond said product facing surface, to operatively contact said displayed product, when in said secured attachment.

32. The security apparatus of claim 31, wherein said microswitch is electrically closed when said security apparatus and said displayed product are attached one to the other, to thereby produce said first signal, and is electrically open when said security apparatus and said displayed product are separated one from the other, to thereby produce said second signal.

33. The security apparatus of claim 32, wherein said microswitch is a normally open microswitch.

34. The security apparatus of claim 33, wherein said housing means further comprises a light emitting diode electrically connected to said alarm system by means of said multiconductor cord.

* * * * *